US009912047B2

(12) United States Patent
Eberly et al.

(10) Patent No.: US 9,912,047 B2
(45) Date of Patent: Mar. 6, 2018

(54) FLUSH-MOUNTED ANTENNA COVER

(71) Applicant: PARK TEQ, LLC, Houston, TX (US)

(72) Inventors: Chad W. Eberly, Chappell Hill, TX (US); George W. Eberly, III, Houston, TX (US); Christopher R. Howerton, Houston, TX (US); Andreas H. Vu, Houston, TX (US)

(73) Assignee: PARK TEQ, LLC, Houston, TX (US)

( * ) Notice: Subject to any disclaimer, the term of this patent is extended or adjusted under 35 U.S.C. 154(b) by 3 days.

(21) Appl. No.: 15/180,698

(22) Filed: Jun. 13, 2016

(65) Prior Publication Data

US 2016/0380344 A1 Dec. 29, 2016

Related U.S. Application Data

(60) Provisional application No. 62/183,485, filed on Jun. 23, 2015.

(51) Int. Cl.

| | |
|---|---|
| ***H01Q 1/50*** | (2006.01) |
| ***H01Q 1/42*** | (2006.01) |
| ***H01Q 1/12*** | (2006.01) |
| ***H01Q 1/22*** | (2006.01) |

(52) U.S. Cl.

CPC ..... *H01Q 1/42* (2013.01); *H01Q 1/1221* (2013.01); *H01Q 1/2233* (2013.01)

(58) Field of Classification Search

CPC ..... H01Q 1/2233; H01Q 1/1221; H01Q 1/42; H01Q 1/50

See application file for complete search history.

(56) References Cited

U.S. PATENT DOCUMENTS

| | | | | |
|---|---|---|---|---|
| 5,825,303 | A * | 10/1998 | Bloss, Jr. | H01Q 1/22 324/74 |
| 6,072,405 | A * | 6/2000 | Sears | G01F 15/063 340/870.02 |
| 6,177,883 | B1 | 1/2001 | Jennetti et al. | |
| 6,414,605 | B1 | 7/2002 | Walden et al. | |
| 6,617,976 | B2 | 9/2003 | Walden et al. | |
| 7,283,063 | B2 | 10/2007 | Salser | |
| 7,365,687 | B2 | 4/2008 | Borleeske et al. | |
| 7,446,672 | B2 * | 11/2008 | Johnson | G01D 4/004 340/870.02 |
| 7,510,422 | B2 | 3/2009 | Showcatally et al. | |
| 8,610,594 | B1 * | 12/2013 | Salser, Jr. | G01D 4/002 340/870.02 |
| 8,878,690 | B2 * | 11/2014 | Olson | G01D 4/004 340/870.02 |

(Continued)

*Primary Examiner* — Hoang Nguyen

(74) *Attorney, Agent, or Firm* — Egbert Law Offices, PLLC

(57) ABSTRACT

An antenna cover has a plate with a top surface and outer perimetric edge, and a housing affixed to or integrally formed with the plate. The housing extends downwardly from an underside of the plate. The housing is positioned within the outer perimetric edge. The housing is adapted to receive an antenna therein. The plate is formed of a radio-frequency transmissive material. The top surface of the plate taper slightly upwardly from the outer perimetric edge. The housing has a generally rectangular configuration with an open bottom. The plate is formed of a material such as an acetyl copolymer, and acetyl homopolymer and, or a polyester-reinforced thermoplastic.

14 Claims, 4 Drawing Sheets

(56) References Cited

U.S. PATENT DOCUMENTS

| | | | | |
|---|---|---|---|---|
| 2010/0026515 | A1 | 2/2010 | Lazar et al. | |
| 2010/0112981 | A1 | 5/2010 | Crowther et al. | |
| 2015/0122959 | A1* | 5/2015 | Cook ..... | G01F 15/18 248/205.1 |

* cited by examiner

FLUSH-MOUNTED ANTENNA COVER

CROSS-REFERENCE TO RELATED APPLICATIONS

The present application claims priority from U.S. Provisional Patent Application Ser. No. 62/183,485, filed on Jun. 23, 2015, and entitled "Flush-Mounted Antenna Cover".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the reading of utility meters. More particularly, the present invention relates to transmitters and antennas used to transmit signals corresponding to utility consumption. More particularly, the present invention relates to covers used with the antenna of the utility meter.

2. Description of Related Art Including Information Disclosed Under 37 CFR 1.97 and 37 CFR 1.98.

Utility meters, including mechanical, electromechanical, and solid-state meters, are well known and have been used for many years to measure the consumption of resources such as water, gas and electricity. Water meters, for example, generate data indicative of the consumption of water, where such data is used for billing purposes. Initially, utility meters were mechanical devices. As electronic technology advanced, such technology became smaller and less expensive, and thus, more suitable for use in the highly competitive and cost-sensitive utility meter market. As such, the use of electromechanical (hybrid meters) and electronic meters has become more common.

Traditionally, meter reading personnel would periodically travel to each site were a utility meter was installed, inspect a meter installation and manually record consumption data. The customer would then receive a bill based on such collected data. Today, modern meters are increasingly equipped with Automatic Meter Reading capabilities which allow utility meters to automatically communicate data to a remote location. Such technology greatly simplifies and lowers the cost of collecting consumption data for billing purposes. A meter which is intended to be remotely read is installed with a radio transmitter. The radio transmitter produces radio frequency energy that is coupled to an antenna for broadcasting.

Generally, the nature of such arrangements results in the antenna be placed in an outdoor environment, often at ground level, and in close proximity to a variety of materials and varying weather conditions. Nearby materials may include items such as metal, plastic, concrete or organic materials. Weather conditions may involve, from time-to-time, environmental exposure to ice, snow, water and temperature extremes (both cold and hot).

The radio frequency energy actually irradiated into the airwaves as compared with that intended to be irradiated is a function of a number of factors. Such factors may include the applied voltage, the amount of current flowing through the antenna, the frequency of the signal applied to the antenna, the material from which the antenna is made, the geometry of such antenna, and the materials that are in the close surrounding space of the antenna. When the surroundings of the antenna vary, the antenna performance (i.e. the degree of the radiated energy therefrom) will also tend to vary correspondingly. The more that adjacent or nearby materials tend to permeate the environment of a particular antenna, the greater the effects on the antenna and its performance, typically to the detriment of such performance.

To achieve a desired range and reliability of radio frequency communications from pit box generated data, it would be desirable to maintain a controlled and uniform radio frequency radiation pattern from the antenna used. One type of antenna conventionally used for utility meter remote transmitting utilizes a conventional loop antenna design as the irradiator element. Generally speaking, the proximity to the ground which is required for the arrangement results in a deformation in the irradiation pattern produced by the irradiated signal.

Problems encountered with such non-uniform irradiation patterns are further complicated by the fact that irradiated energy may vary from place to place where the antenna is installed. For example, in some antenna systems, there may be multiple transmitters that will be sending data to a receiver system, or the transmitter antenna will be installed in mild steel, aluminum, fiberglass, cast-iron, plastic, or concrete lids of boxes installed underground. The lids thereof are generally flush with ground-level. Such boxes are commonly called pit boxes or vaults in the utility industry, particularly in the water utility industry.

A number of attempts have been made to provide an antenna system that is capable of operating, in particular, from a water meter pit box environment. However, complete systems for water meters, on occasion, have been required to be removed from the field for reasons such as poor antenna function, poor range, inconsistent range, and other related problems that also affect the life and/or durability of the effective water meter reading system using a radio frequency transmitter system for data collection.

In the past, various patents have issued relating to the transmission of utility meter information to a remote environment. For example, U.S. Pat. No. 6,177,883, issued on Jan. 23, 2001 to Jennetti et al, shows a utility meter transponder exposed ground-level antenna assembly. This is an arrangement for utility meter reading, processing and data acquisition for use with an automatic billing system involving water meter transmitter antenna system installed at or near ground-level in an outdoor environment. A radio frequency utility meter communication apparatus transmits utility meter data to a remote utility meter data collection unit from an underground pit box. The pit box receives a utility meter and has a generally ground-level lid with an opening therethrough. An antenna element has an upper member extending at least partially through the pit lid opening and received thereabove. A depending base of the antenna element extends from the upper element and passes through the pit lid opening into the underground pit box. The antenna element is at least partly exposed to its surrounding environment. A radio frequency transmitter inside the underground pit box is associated with the antenna element depending base so that radio frequency signals output by the transmitter are propagated by the antenna element.

U.S. Pat. No. 6,414,605, issued on Jul. 2, 2002 to Walden et al., describes an apparatus and methodology for radio utility meter reading, processing and data acquisition for use with an automatic billing system. This apparatus includes a utility meter transmitter antenna system installed at or near ground-level. A radio frequency utility meter communication apparatus transmits utility meter data to a remote utility meter data collection unit from an underground pit box. The pit box includes a utility meter and has a generally ground-level lid with an opening therethrough. The antenna element has an upper member depending at least partly through the pit lid opening. The depending antenna element is capacitively coupled or provided with some sort of non-mechanical coupling to the output of an RF transmitter also included within the pit box. The antenna element components are nested for ease of attachment to or removal from a pit lid and has a rotatable threaded nut received about a depending antenna element for drawing tight against the underside of the pit lid. U.S. Pat. No. 6,617,976, issued on Sep. 9, 2003 to Walden et al., describes a system similar to that of U.S. Pat. No. 6,414,605.

U.S. Pat. No. 7,283,063, issued on Oct. 16, 2000 to F. S. Salser, shows automatic meter reading technology having a communication apparatus. The communication apparatus includes a transmitter associated with an antenna wherein the transmitter is in communication with a utility meter installed in an underground enclosure. The communication apparatus includes a housing comprising a top section and a depending base. The top section at least partially houses the transmitter and the antenna with a depending base housing a power source operatively connected to the transmitter. The top section is adjacent to an exterior side surface of the underground enclosure.

U.S. Pat. No. 7,365,687, issued on Apr. 29, 2008 to Borleeske et al., provides an antenna with a disc radiator used in automatic meter reading. The antenna includes a pin and a radiator. The radiator is a disc radiator that comprises an opening that receives the pin. The pin is affixed to the radiator at one end and is disposed on a ground plane at the other end. The antenna can be a top-loaded short monopole antenna. The antenna may be used with a water meter.

U.S. Pat. No. 7,510,422, issued on Mar. 31, 2009 to Showcatally et al., discloses a breakaway device for use in a meter pit environment that protects connections between the components of an automatic meter reading system. At least one cable is adapted to operably couple a first automatic meter reading device and a second automatic meter reading device. Each of these devices is disposed in a utility meter pit. At least one connector is adapted to be operatively coupled to the first device or the second device and is constructed to be the decoupleable in response to a force that is less than the linear breaking strength of the cable.

U.S. Patent Publication No. 2010/0026515, published on Feb. 4, 2010 to Lazar et al., teaches a pit transmitter assembly for radio frequency communication of signals representing utility meter data. A transmitter is supported by a transmitter substrate, a planar ground conductor disposed over the transmitter, an antenna substrate disposed on an edge of the planar ground conductor, and a flat coil antenna conductor disposed on two opposite sides of the antenna substrate. The transmitter includes an L-C circuit connected to the antenna conductor to provide operation of the antenna in a desired frequency range.

U.S. Patent Publication No. 2010/0112981, published on May 10, 2012 to Crowther et al., provides an antenna mounting apparatus for mounting a water meter antenna in a boundary box lid. This apparatus includes an inverted vessel adapted to both receive the antenna and orient the antenna such that the electromagnetic radiation substantially propagates out of a boundary box covered by a boundary box lid. The inverted vessel includes a resilient mounting means adapted to secure the antenna in the vessel. A carrier is provided that is adapted to receive the vessel. The carrier includes a resilient mounting means adapted to secure the inverted vessel in the carrier.

It is an object of the present invention to provide an antenna cover that can be easily retrofitted to existing utility vaults.

It is another object of the present invention to provide an antenna cover that does not interfere with radio frequency transmission.

It is another object of the present invention to provide an antenna cover that provides a sealed environment for the electronics associated with the transmission of the utility meter signal.

It is another object of the present invention provide an antenna cover that can be generally flush mounted to the lid of a utility vault.

It is another object of the present invention to provide an antenna cover that minimizes the risk of tripping to those persons walking over the cover.

It is another object of the present invention to provide an antenna cover that can be easily installed.

It is still further object of the present invention to provide an antenna cover that is relatively inexpensive and easy to manufacture.

These and other objects and advantages of the present invention will become apparent from a reading of the attached specification and appended claims.

BRIEF SUMMARY OF THE INVENTION

The present invention is an antenna cover the comprises a plate having a top surface and an outer perimetric edge, and a housing affixed to or integrally formed with the plate. The housing extends downwardly from an underside of the plate. The housing is positioned within the outer perimetric edge of the plate. The housing is adapted to receive an antenna therein. The plate is formed of a radio-frequency transmissive material.

The top surface of the plate tapers slightly upwardly from the outer perimetric edge. In particular, the plate is formed of a material selected from the group consisting of an acetyl copolymer, and acetyl homopolymer and a polyester-reinforced thermoplastic.

The housing has a generally rectangular configuration and an open bottom. The interior volume of the housing is adapted to receive the antenna therein. In particular, the housing has a bottom edge at the open bottom. The bottom edge has at least one cut-out formed therein. It is this cut-out that serves to receive the antenna within the interior volume of the housing. The bottom edge also has at least one receptacle formed therein. The bracket has at least one hole corresponding in location to the receptacle. The bracket also has sides that extend upwardly. Each of the sides of the bracket has a length less than a width of the side of the rectangular configuration of the housing. At least one fastener extends through the hole of the bracket and is received in the receptacle at the bottom edge of the housing. The fastener secures the bracket against the bottom edge of the housing.

In the present invention, gasket is affixed to the underside of a plate. The gasket is positioned within the outer perimetric edge of the plate and beyond the housing.

The present invention is also an apparatus comprises a panel having a top surface and an aperture formed therethrough, a plate having a top surface and an underside and an outer perimetric edge. The plate overlies the aperture such that the outer perimetric edge resides on the panel. A housing is affixed to or integrally formed with the plate. The housing extends downwardly from the underside the plate and into the aperture the panel. The housing is adapted to receive an antenna therein.

The top surface of the plate tapers slightly upwardly from the outer perimetric edge. The plate of the apparatus the present invention is of material selected from the group consisting of an acetyl copolymer, and acetyl homopolymer and a polyester-reinforced thermoplastic.

The housing has a generally rectangular configuration and an open bottom. An interior volume of the housing is adapted to receive the antenna therein. In particular, the housing has a bottom edge at this open bottom. The bottom edge has at least one cut-out formed therein. The bottom edge has at least one receptacle formed therein. A bracket has at least one hole therein corresponding in location to the receptacle. The bracket has sides extending upwardly. Each of the sides of the bracket has an upper end abutting a bottom surface of the panel. At least one fastener extends through the hole of the bracket and is received in the receptacle at the bottom edge of the housing. The fastener secures the bracket against the bottom edge of the housing. A gasket is affixed to the underside of the plate. The gasket is interposed between the underside of the plate and the top surface of the panel.

In the apparatus of the present invention, the panel is, in particular, a top surface of a utility vault. An antenna is affixed within the cut-out at the bottom edge of the open bottom of the housing. The utility vault has a meter therein. The meter is cooperative with the antenna within the interior volume of the utility vault. In particular, the top surface of the utility vault is a lid that is hingedly mounted to the utility vault. The aperture is formed in the lid.

The present invention is also a utility vault apparatus the comprises a utility vault having an interior volume and a top surface. The top surface has an aperture formed therein. A meter is positioned in the interior volume of the utility vault. A plate is provided having a top surface and an underside and an outer perimetric edge. The plate overlies the aperture such that the outer perimetric edge resides on the top surface of the utility vault. A housing is affixed to or integrally formed with the plate. The housing extends downwardly from the underside of the plate and into the aperture in the top surface of the utility vault. The housing is adapted to receive an antenna therein.

This foregoing Section is intended describe, with particularity, the preferred embodiments of the present invention. It is understood that modifications to these preferred embodiments can be made within the scope of the present invention. As such, this Section should not be construed, in any way, as limiting of the broad scope of the present invention. The present invention should only be limited by the following claims and their legal equivalents.

DETAILED DESCRIPTION OF THE INVENTION

Figure 1:
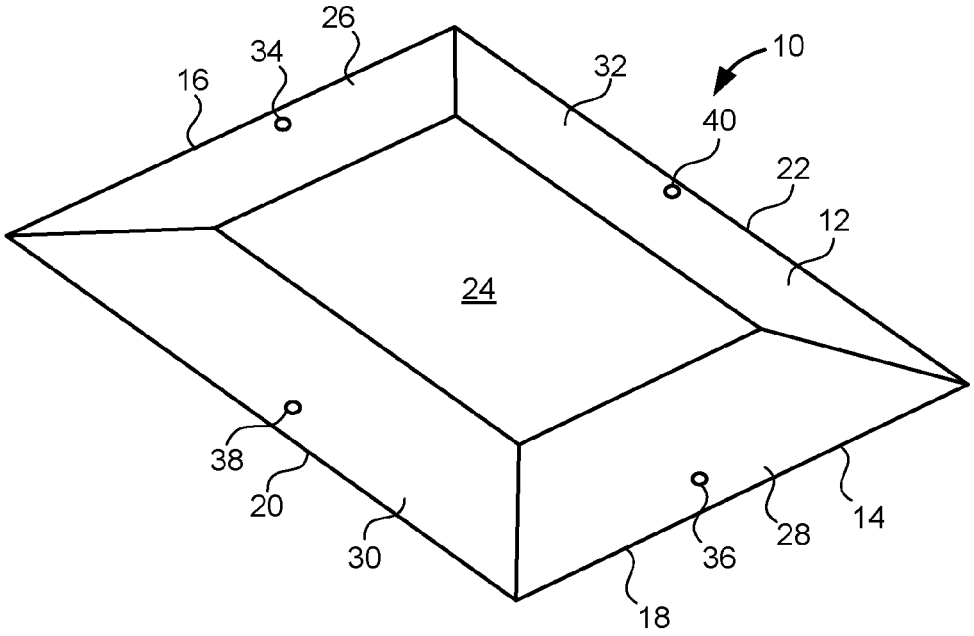
FIG. 1 is an upper perspective view of the antenna cover of the present invention.

Referring to FIG. 1, there is shown the antenna cover 10 in accordance with the teachings of the preferred embodiment of the present invention. The antenna cover 10 includes a plate 12. The plate 12 is illustrated as having a generally rectangular configuration. The plate 12 has an outer perimetric edge 14. In particular, the plate 12 has end edges 16 and 18 and side edges 20 and 22. The plate 12 also has a central area 24. Central area 24 is of a generally planar surface.

In FIG. 1, there is a tapered surface 26 that extends from the end edge 16 upwardly toward the central area 14. Another tapered surface 28 extends from the end edge 18 upwardly toward the central area 24. A tapered surface 30 extends from side edge 20 to the central area 24. Additionally, there is another tapered surface 32 that extends from the side edge 22 to the central area 24. In this arrangement, the elevation of the plate 12 will be minimal along the perimetric edge 14. The tapered surfaces 26, 28, 30 and 32 gradually extend upwardly toward the central area 24. As a result, these tapered surfaces 26, 28, 30 and 32 provide a very gradual transition to the central area 24. This serves to minimize the risk of tripping by persons walking along the top surface of the utility vault.

A hole 34 is formed through the tapered surface 26 adjacent to the end edge 16. A hole 36 is formed through the tapered surface 28 generally adjacent to the end edge 18. A hole 38 is formed in the tapered surface 30 adjacent to the side edge 20. Another hole 40 is formed on the tapered surface 32 adjacent to the side edge 22. These holes 34, 36, 38 and 40 facilitate the ability to install fasteners so as to fixedly secured the plate 12 in a liquid-tight relationship with the utility vault.

Figure 2:
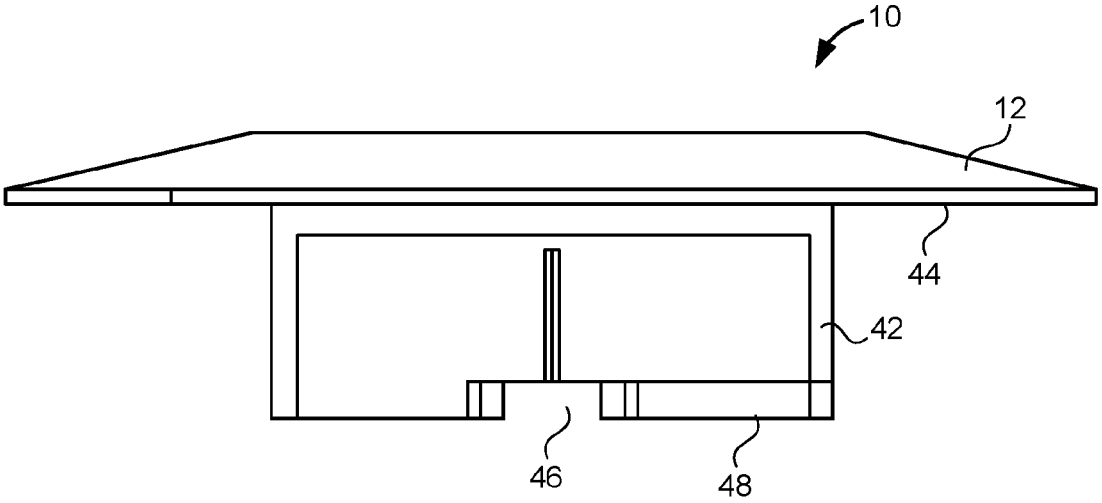
FIG. 2 is an end elevational view of the antenna cover of the present invention.

FIG. 2 shows an end view of the antenna cover 10 of the present invention. In FIG. 2, it can be seen that there is a housing 42 that extends downwardly from the underside 44 of the plate 12. The housing 42 can be integrally formed with the plate 12 or can be affixed thereto. The housing 42 will have a generally rectangular configuration. A cutout 46 is formed at the bottom edge 48 of the housing 42. The cutout 46 is suitable for the receipt of the antenna, or antenna structure, therein.

Figure 3:
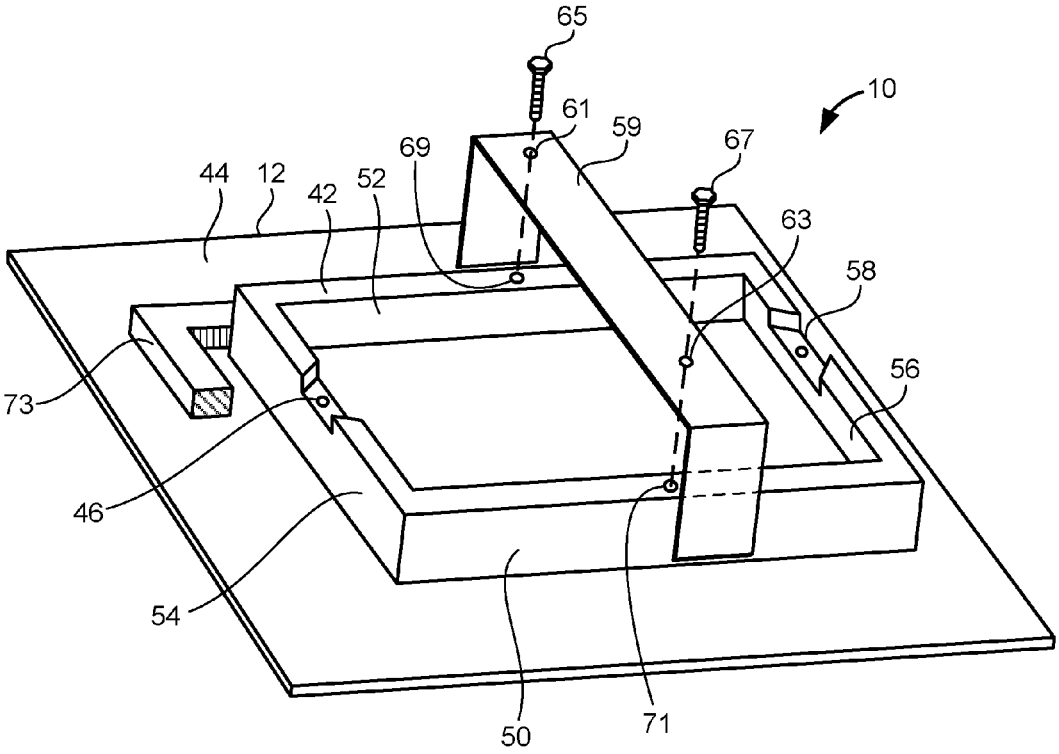
FIG. 3 is a lower perspective view of the antenna cover of the present invention.

FIG. 3 shows the antenna cover 10 from a lower perspective view. In FIG. 3, it can be seen that the housing 42 extends from the underside 44 of the plate 12. The housing 42 has a generally rectangular configuration. The housing 42 is located centrally of the plate 12 and generally corresponds, in location, to the central planar area 24 of the plate 12. The housing 42 includes sidewalls 50 and 52 and end walls 54 and 56. The end wall 54 includes the cutout 46 at the lower edge thereof. End wall 56 includes another cutout 58 at the lower edge thereof. Each of the cutouts 46 and 58 are suitable for receiving a portion of the antenna structure therein. As such, the antenna will be supported within the interior of the housing 42.

A retainer bracket 59 is used to secure the antenna cover 10 to a utility vault. The retainer bracket 59 is a stainless steel bar bent into a U-shape. A pair of holes 61 and 63 are formed on a horizontal portion of the retainer bracket. The holes 61 and 63 receive bolts 65 and 67 therein. The bolts 65 and 67 are of a stainless steel material. Bolts 65 and 67 screw into brass inserts 69 and 71 that are molded into a lower end surface of side walls 52 and 50, respectively. A perimeter gasket 73 is shown only partially in FIG. 3. In actually, the perimeter gasket 73 can extend entirely, or partially, around the housing 42.

Figure 4:
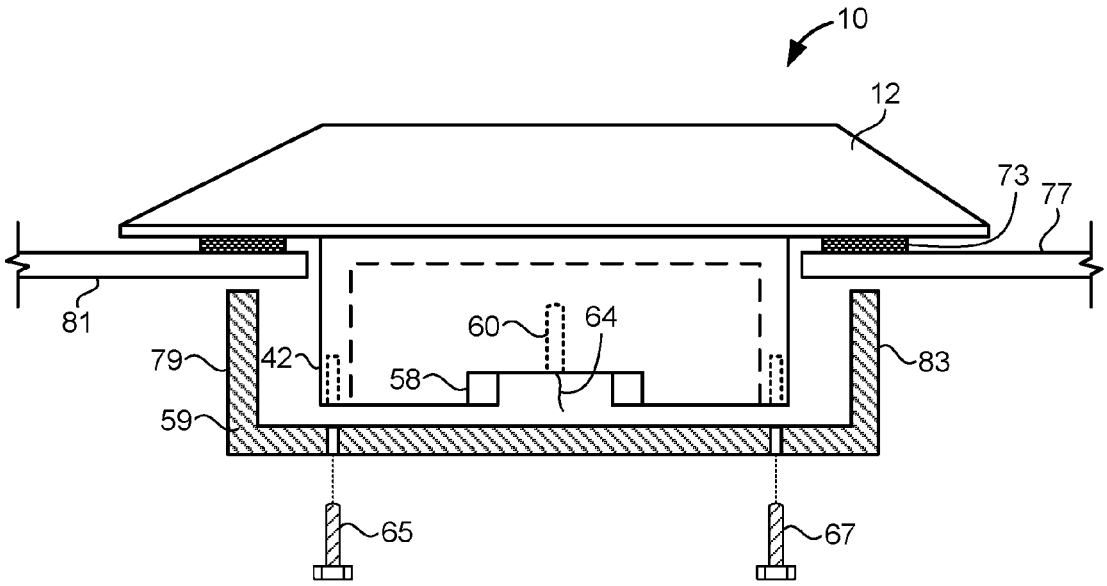
FIG. 4 is a side elevational view of the antenna cover the present invention showing, in particular, the antenna cover as positioned on top surface of a utility vault.

FIG. 4 illustrates how the antenna 60 is supported within the housing 42 of the antenna cover 10. In particular, the antenna 60 includes a structure that has one and received by the cutout 58 and opposite and received by the cutout 46. As such, the antenna 60 will be supported interiorly within the housing 42 in a location below the plate 12. A line 64 is connected to the antenna 60 so as to extend to the utility meter. Within the concept of the present invention, the antenna 60 can also be in a wireless connection with the utility meter. Importantly, the antenna covered 10 is formed of a polymeric material. One type of polymeric material is DELRIN™ material. This DELRIN™ can be an acetyl copolymer material or an acetyl homopolymer material. Another type of polymeric material is ESTALOC™. ESTALOC™ is a polyester-type reinforced engineering thermoplastic. A variety of the type of polymers can also be used. These polymer should be extremely radio frequency transmissive. As such, the material of the antenna cover 10 will not block or interfere with transmissions by the antenna 60.

FIG. 4 further shows how the antenna cover 10 is secured to the bracket 59 at a top surface 77 of the utility vault. This top surface can be in the nature of a panel. One side 79 of the bracket 59 has an end that abuts an underside 81 of the top surface 77. Another side 83 abuts the underside of the top surface 77. As such, when the bracket 59 is secured by bolts 65 and 67 to the housing 42, the top surface 77 will be sandwiched between the peripheral surface of plate 12 and the abutting ends of sides 79 and 83. The perimeter gasket 73 will thereby be compressed so as to achieve a liquid-tightness between the plate 12 and the top surface 77 of the utility vault.

Figure 5:
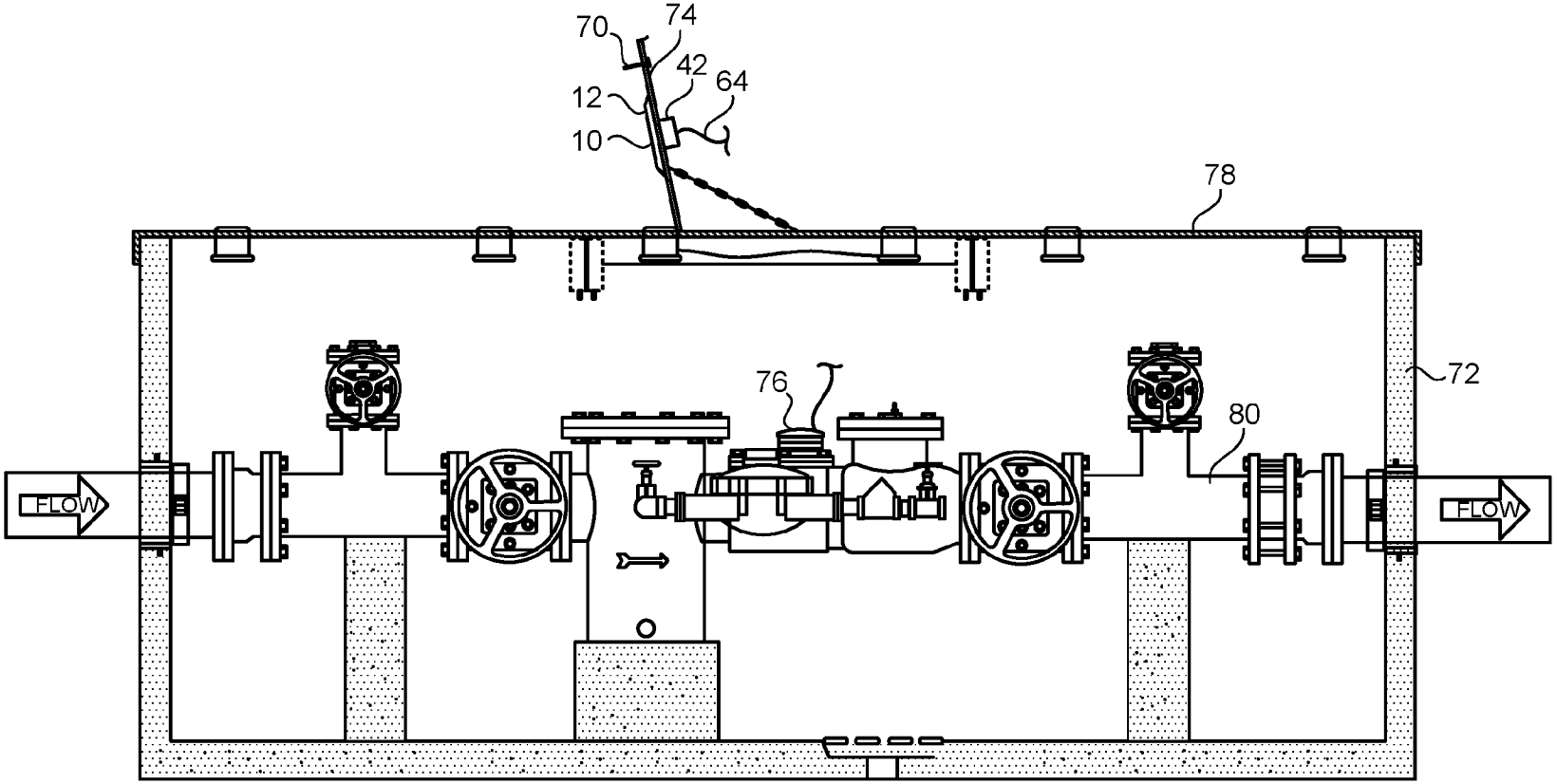
FIG. 5 is a cross-sectional view showing the antenna cover of the present invention as placed on the lid of a utility vault.

FIG. 5 illustrates the antenna cover 10 as positioned on a lid 70 of a utility vault 72. The lid 70 is illustrated as in an open configuration. The plate 12 of the antenna cover 10 will be positioned on the outer surface of the lid 70. The housing 42 extends through an aperture formed in the lid 70 so as to be located outwardly of the underside 74 of the lid 70. Line 64 will extend from the antenna located within the housing 42 so as to be connected to the utility meter 76 located within the interior of the utility vault 72. The utility meter 76 will be, in the preferred embodiment, a water meter. Importantly, the antenna cover can also be placed in another location on the top surface of the utility vault 72.

The utility vault 72 is illustrated as having a generally rectangular configuration and having a top surface 78. When the lid 70 is closed, it will be flush with the top surface 78. The plate 12 will extend only slightly above the top surface of the lid 70 and above the top surface 78 of the utility vault 72. The utility vault 72 includes piping 80 which connects to the utility meter 76. As such, the utility meter 76 is configured so as to measure usage of materials, water, gas, or other materials flowing through the piping 80.

The present invention allows the antenna cover 10 to be easily retrofitted to existing utility vaults. In order to affix the antenna cover 10 to the lid 70, is only necessary to form an aperture in the lid 70 or in any other location on the top surface. The housing 42 can then be pushed through this aperture such that the plate 12 will overlie the aperture. Fasteners can be utilized so as to secure the outer periphery of the plate 12 to the top surface of the lid 70 or be affixed in the manner shown in FIG. 4. Within the concept of the present invention, these fasteners can include screws, bolts, adhesive materials, brackets, or silicone. As such, the plate 12 can be installed in a liquid-tight manner upon the lid 70. The line 64 can be connected to the utility meter 76. When access to the utility meter 76 or to the antenna within the housing 42 is desired, the lid 70 can be moved to its open position so as to expose the interior of the vault 72 and the utility meter 76 and also expose the antenna within the housing 42.

The use of the polymeric material will not interfere with the transmission of the antenna. The use of suitable sealing materials will maintain the antenna, along with the electronics associated therewith, in a sealed environment. The plate 12 is generally flush-mounted to the lid 70. As such, this will minimize the risk of tripping by those persons that would be walking across the top surface 78 of the utility vault 72. Since the antenna cover 10 is of a formed polymeric material, it is relatively inexpensive and easy to manufacture.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An antenna cover comprising:

a plate having a top surface and an outer perimetric edge, said plate being formed of a radio frequency transmissive material; and a housing affixed to or integrally formed with said plate, said housing extending downwardly from an underside of said plate, said housing positioned within said outer perimetric edge, said housing adapted to receive an antenna therein, said housing having generally rectangular configuration with an open bottom and an interior volume, said interior volume adapted to receive the antenna therein, said housing having a bottom edge at said open bottom, said bottom edge having at least one cut-out formed therein.

2. The antenna cover of claim 1, said top surface of said plate tapering slightly upwardly from said outer perimetric edge.

3. The antenna cover of claim 1, said plate being of a material selected from the group consisting of an acetyl copolymer, and acetyl homopolymer and a polyester-reinforced thermoplastic.

4. The antenna cover of claim 1, said bottom edge having at least one receptacle formed therein, the antenna cover further comprising:

a bracket having at least one hole therein corresponding in location to the receptacle, said bracket having sides extending upwardly, each of said sides having a length less than a width of a side of said rectangular configuration of said housing; and at least one fastener extending through the hole of said bracket and received in said receptacle at said bottom edge of said housing, the fastener securing said bracket against said bottom edge of said housing.

5. The antenna cover claim 1, further comprising:

a gasket affixed to said underside of said plate, said gasket positioned within said outer perimetric edge and beyond said housing.

6. An apparatus comprising:

a panel having a top surface in an aperture formed therethrough;

a plate having a top surface and an underside and an outer perimetric edge, said plate overlying said aperture such that said outer perimetric edge resides on said panel; and a housing affixed to or integrally formed with said plate, said housing extending downwardly from said underside of said plate and into said aperture of said panel, said housing adapted to receive an antenna therein, said housing have a generally rectangular configuration with an open bottom and interior volume, said interior volume adapted to receive the antenna therein, said housing having a bottom edge at said open bottom, said bottom edge having at least one cut-out formed therein.

7. The apparatus of claim 6, said top surface of said plate tapering slightly upwardly from said outer perimetric edge.

8. The apparatus of claim 6, said plate being of a material selected from the group consisting of an acetyl copolymer, and acetyl homopolymer and a polyester-reinforced thermoplastic.

9. The apparatus of claim 6, further comprising:

an antenna affixed within the cut out-out at said bottom edge of said open bottom of said housing.

10. An apparatus comprising:

a panel having a top surface in an aperture formed therethrough;

a plate having a top surface and an underside and an outer perimetric edge, said plate overlying said aperture such that said outer perimetric edge resides on said panel;

a housing affixed to or integrally formed with said plate, said housing extending downwardly from said underside of said plate and into said aperture of said panel, said housing adapted to receive an antenna therein, said housing have a generally rectangular configuration with an open bottom and interior volume, said interior volume adapted to receive the antenna therein, said housing having a bottom edge at said open bottom, said bottom edge having at least one receptacle formed therein;

a bracket having at least one hole therein corresponding in location to the receptacle, said bracket having sides extending upwardly, each of said sides of said bracket having an upper end abutting a bottom surface of said panel; and at least one fastener extending through the hole of said bracket and received in said receptacle at said bottom edge of said housing, the fastener securing said bracket against said bottom edge of said housing.

11. The apparatus of claim 10, further comprising:

a gasket affixed to said underside of said plate, said gasket interposed between said underside of said plate and said top surface of said panel.

12. The apparatus of claim 10, said panel being a top surface of a utility vault.

13. The apparatus of claim 12, further comprising:

an antenna mounted within said housing, said utility vault having a meter therein, said meter cooperative with said antenna within an interior volume of said utility vault.

14. The apparatus of claim 12, said top surface of said utility vault being a lid hingedly mounted to said utility vault, said aperture formed in said lid.

* * * * *